US007168483B2

(12) United States Patent
Blomgren et al.

(10) Patent No.: US 7,168,483 B2
(45) Date of Patent: Jan. 30, 2007

(54) HEAT TRANSFER PLATE, PLATE PACK AND PLATE HEAT EXCHANGER

(75) Inventors: Ralf Blomgren, Skanör (SE); Karl Martin Holm, Lund (SE)

(73) Assignee: Alfa Laval Corporate AB, Lund (SE)

( * ) Notice: Subject to any disclaimer, the term of this patent is extended or adjusted under 35 U.S.C. 154(b) by 406 days.

(21) Appl. No.: 10/250,340

(22) PCT Filed: Jan. 4, 2002

(86) PCT No.: PCT/SE02/00009

§ 371 (c)(1),
(2), (4) Date: Nov. 12, 2003

(87) PCT Pub. No.: WO02/053998

PCT Pub. Date: Jul. 11, 2002

(65) Prior Publication Data

US 2004/0069473 A1 Apr. 15, 2004

(30) Foreign Application Priority Data

Jan. 4, 2001 (SE) ..... 0100028

(51) Int. Cl.
*F28F 3/08* (2006.01)

(52) U.S. Cl. ..... 165/167; 165/DIG. 367

(58) Field of Classification Search ..... 165/166, 165/167

See application file for complete search history.

(56) References Cited

U.S. PATENT DOCUMENTS 2,610,835 A 9/1952 Hytte
3,469,626 A * 9/1969 Wilson et al. ..... 165/166
3,783,090 A * 1/1974 Andersson et al. ..... 165/166
4,125,149 A 11/1978 Kritzler et al.
4,423,772 A * 1/1984 Dahlgren ..... 165/166
4,635,714 A * 1/1987 Almqvist et al. ..... 165/167
4,781,248 A * 11/1988 Pfeiffer ..... 165/167
4,915,165 A * 4/1990 Dahlgren et al. ..... 165/166
5,398,751 A * 3/1995 Blomgren ..... 165/166

FOREIGN PATENT DOCUMENTS

| | | |
|---|---|---|
| DE | 863816 | 1/1953 |
| FR | 2 348 460 | 11/1977 |
| GB | 1 201 151 | 8/1970 |
| WO | WO 8701795 | 3/1987 |

* cited by examiner

*Primary Examiner*—Allen J. Flanigan
(74) *Attorney, Agent, or Firm*—Fish & Richardson P.C.

(57) ABSTRACT

A heat transfer plate for a plate heat exchanger including a number of ridges (210) and troughs (220) which have been pressed into the plate, the heat transfer portion of the plate having a plurality of juxtaposed rows (200) of the ridges (210) and troughs (220). The rows (200) of ridges (210) and troughs (220) are separated from each other by essentially plane channel portions (240). Each row (200) presents alternating elongated ridges (210) and elongated troughs (220) which extend along a main flow direction (F). The transition between each ridge (210) and an adjacent trough (220) in the same row (200) is formed by a transition portion (230) which is inclined relative to the central plane (P1) of the plate (1). The heat transfer plate is used in a plate pack for a plate heat exchanger.

23 Claims, 9 Drawing Sheets

Fig. 13
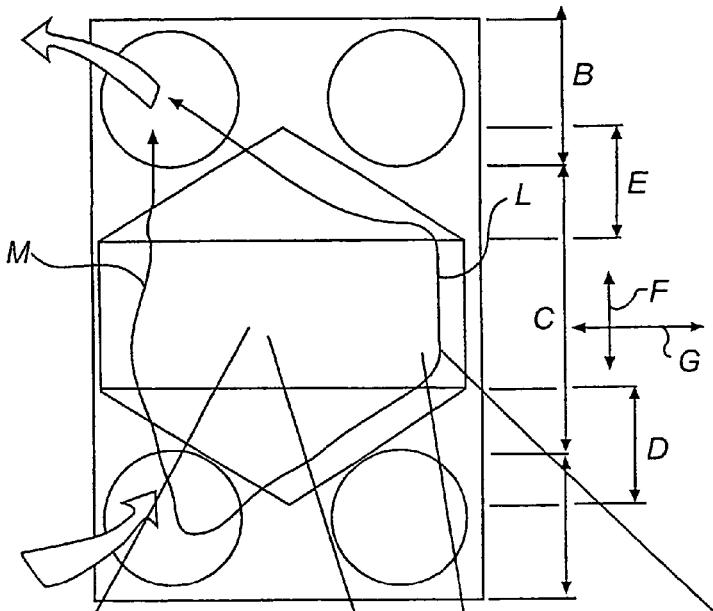
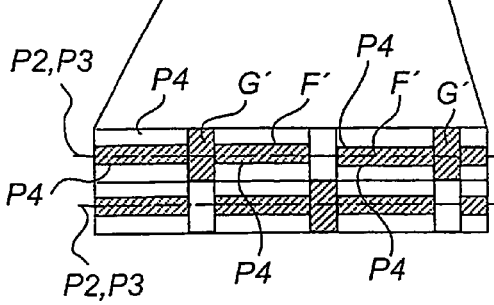
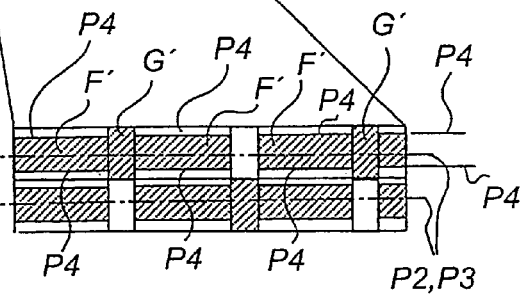
Fig. 14
Fig. 15

HEAT TRANSFER PLATE, PLATE PACK AND PLATE HEAT EXCHANGER

FIELD OF THE INVENTION

The present invention relates to a heat transfer plate for a plate heat exchanger, comprising an inlet portion, an outlet portion and a heat transfer portion which is located between the inlet portion and the outlet portion and which presents a number of ridges and troughs pressed into the plate and extending between a geometric top plane and a geometric bottom plane of the plate, said planes being essentially parallel to the geometric central plane of the plate. The invention further relates to a plate pack comprising a plurality of heat transfer plates of the type stated above, in which plate pack a fluid is intended to flow in a number of the flow areas that are formed by the interspaces between the heat transfer plates constituting the plate pack along a main flow direction extending between the inlet portion and the outlet portion. The invention also concerns a plate heat exchanger.

BACKGROUND ART

A plate heat exchanger comprises a plate pack consisting of a number of assembled heat transfer plates forming between them plate interspaces. In most cases, every second plate interspace communicates with a first inlet channel and a first outlet channel, each plate interspace being adapted to define a flow area and to pass a flow of a first fluid between said inlet and outlet channels. Correspondingly, the other plate interspaces communicate with a second inlet channel and a second outlet channel for a flow of a second fluid. Thus, the plates are in contact with one fluid through one of their side surfaces and with the other fluid through the other side surface, which allows a considerable heat exchange between the two fluids.

Modern plate heat exchangers have heat transfer plates, which in most cases are made of sheet bars that have been pressed and punched to obtain their final shape. Each heat transfer plate is usually provided with four or more "ports" consisting of through holes punched in the plate. The ports of the different plates define said inlet and outlet channels, which extend through the plate heat exchanger transversely of the plane of the plates. Gaskets or any other form of sealing means are alternatingly arranged around some of the ports in every second plate interspace and, in the other plate interspaces, around the other ports so as to form the two separate channels for the first fluid and the second fluid, respectively.

Since the fluid pressure levels attained in the heat exchanger during operation are considerable, the plates need to have a certain rigidity so as not to be deformed by the fluid pressure. The use of plates made of sheet bars is possible only if the plates are somehow supported. As a rule, this is solved by the heat transfer plates being designed with some kind of pattern so that the plates bear against each other in a large number of points. The plates are clamped together between two rigid end plates in a "frame" and thereby form rigid units having flow channels in each plate interspace. To obtain the desired contact between the plates, two different types of plates are manufactured, which are then alternatingly arranged in such manner that the plates in the heat exchanger are alternately of a first kind and of a second kind. Alternatively, use is made of identical plates which alternately are turned or flipped about a symmetry axis.

In most cases, the ports for the respective flow areas are located in two port portions at two opposite edges of the heat transfer plate, and said flow areas are formed by a heat transfer surface located between the port portions. In the portion of the plated located closest to the ports (the distribution surface), the plates usually have a pattern which has been specially designed to distribute the fluids over the entire width of the flow area.

In some applications, the pressure drop across the heat transfer surface represents only a small part of the pressure drop, which means that the difference in pressure drop in the transverse direction will be relatively small even if relatively large differences in fluid flow would arise across the width of the flow area. Although an uneven distribution, even if it is significant, has only a minor effect on the heat transfer in a heat exchanger with clean plates, an unevenly distributed flow is, in many cases, unacceptable since the risk of fouling increases considerably. When fouling occurs, the heat transfer capacity of the heat exchanger is drastically reduced. Besides reducing the thermal efficiency, fouling may also have a detrimental effect on the quality of the product that has passed through the heat exchanger. Furthermore, more cleaning will be required and, in serious cases, unscheduled stoppages may be necessary.

One example of processes where the pressure drop across the heat transfer surface is small is climbing film evaporation.

To obtain a sufficient distribution across the flow area also in applications characterised by low pressure drops, the pattern of the flow area must be 'open', i.e. a sufficient flow should be obtained even without large pressure differences. For the purpose of distribution, the pattern should thus be 'open' in the transverse direction, and for the purpose of main flow, the pattern should be 'open' in the main flow direction. An 'open' pattern is obtained simply by making the plates as plane as possible and providing them with only a small number of local depressions. However, with only a small number of contact points, each contact point has to bear a considerable load and the portions of the plate located between the contact points are subjected to considerable bending loads.

One problem associated with prior art is the fact that there is no structure which in a completely satisfactory manner yields the desired distribution also at small pressure drops while providing a strong plate pack formed by the individual plates.

Known compromises between the two seemingly incompatible construction requirements present too many deficiencies in terms of either distribution or strength.

SUMMARY OF THE INVENTION

An object of the invention is to provide a solution to the problems stated above or at least to achieve a compromise which does not present any appreciable deficiencies in terms of either distribution or strength.

A further object is to provide a heat transfer plate which at least offers an effective compromise concerning the problems stated above and which is easy and inexpensive to manufacture.

Another object is to provide a plate pack and a plate heat exchanger which also at least offer an effective compromise concerning the problems stated above and which are easy and inexpensive to manufacture.

These objects have been attained by means of a heat transfer plate having the features as defined in independent claim 1.

The objects have also been attained by means of a plate pack and a plate heat exchanger having the features as defined in independent claims 18 and 12, respectively.

Preferred embodiments of the invention according to its various aspects are apparent from the dependent claims.

The new pattern of the plate is a solution to the seemingly incompatible construction requirements.

The inventive concept can be summarised as a plate comprising a number of rows of elongated ridges and troughs which extend along the main flow direction and which are adapted on the one hand to support the loads arising between the plates when used in a plate pack in a plate heat exchanger and, on the other hand, to provide flow distributing flow connections, and a number of channel portions separating the rows of ridges and troughs from each other and being adapted to form main flow channels, which only cause marginal pressure drops. This results in a plate with satisfactory strength and satisfactory distribution capacity in the transverse direction also in applications where the pressure drop across the heat transfer surface has to be small. The features stated in claim 1 will be discussed in more detail below.

First, the heat transfer portion comprises a plurality of juxtaposed rows of said ridges and troughs, said rows extending along a main flow direction which extends between the inlet portion and the outlet portion. A plate of this design has a strong heat transfer surface. Strong here means, inter alia, that the plate is able to resist the pressures acting on the plate along its normal, i.e. the pressure associated with the clamping force of the rack as well as the pressure of the fluids flowing in the plate interspaces formed by the plates. The forces acting along the normal can attain considerable levels, since the plates usually have large heat transfer surfaces.

Second, the rows of ridges and troughs are separated from each other in a transverse direction which is essentially perpendicular to the main flow direction and which extends along the central plane of the plate, by essentially plane channel portions of the heat transfer portion which extend essentially parallel to the central plane of the plate. This helps make the pressing relatively uncomplicated. It also means that there will be main flow channels which extend in the main flow direction and which cause only a very small pressure drop. As mentioned above, a small pressure drop is a requirement for certain fields of application.

Third, each row presents alternating elongated ridges and elongated troughs, which extend in said main flow direction. The ridges of two juxtaposed heat transfer plates are adapted to bear against each other. Thus, the elongated ridges, which bear against an adjacent plate, will form a trough on the other side of the plate and will be located a distance from the corresponding trough on the adjacent plate on the other side. Elongated transverse connections are thereby formed between said main flow channels in the main flow direction. Thus, the flow in different main flow channels can be equalized by way of these transverse connections without causing any appreciable pressure drop. Ridge primarily means a convex side of a pressed component and trough means its concave side. Thus, a ridge on a large face of a plate forms a trough on the opposite large face of the plate. The pattern of the plate has been described as it appears on a large face of the plate.

Fourth, the transition between each ridge and an adjacent trough in the same row is formed by a continuous, essentially straight transition portion of the plate, which is inclined relative to said central plane of the plate and of which a first part forms an end wall of said ridge and a second part forms an end wall of the adjacent trough. By the portions being inclined, a pressed pattern is obtained which is relatively easy to produce. Because the inclined transition portions are essentially straight and extend directly from an ridge to a trough, a very strong structure is obtained. An upright portion of a metal sheet can support considerable loads in the plane of the metal sheet portion as compared with a metal sheet portion that is subjected to a load along its normal. By the straight sheet metal portion extending directly from a ridge to an adjacent trough, the compressive force is transmitted between two plates located on either side of an intermediate plate directly from one plate by way of the ridge contact point to the other plate by way of the trough contact point. Consequently, there are no plate portions that are subjected to any appreciable bending loads, which would lead to considerable deflections even in the case of small loads. In this connection, the angle of inclination is a question of optimisation. An orthogonal, upright portion offers a better rigidity but is more difficult to achieve without making the material too thin. Thus, the pressing properties of the material as well as its inherent rigidity, the field of application of the plate etc. need to be taken into consideration.

A further advantage of the plate pattern described above is that the plates can be symmetrically designed to allow the formation of a plate pack in a plate heat exchanger using only one type of plate, every second plate in the plate pack being flipped about a symmetry line.

Advantageously, the channel portions of the plate have an extension which in the transverse direction is greater than the extension, in the transverse direction, of the respective rows of ridges and troughs. This means that there will be no appreciable pressure drop. The rows of ridges and troughs afford the plate the required strength, and the relatively wide channel portions provide channels with high flow capacity.

Preferably, the channel portions have an extension which in the transverse direction is about twice as great as the extension, in the transverse direction, of the respective rows of ridges and troughs. By designing the plate in this manner, the pressure drop will be very small and the plate will have a pattern which makes it strong.

In a preferred embodiment, each elongated ridge is narrower in a central portion thereof in such manner that the portion of the ridge coinciding with the top plane has an extension in the transverse direction which is smaller in the central portion of the ridge in relation to the extension in the end portions of the ridge. By designing the ridge in this manner, the potential heat transfer surface is effectively maintained. The part of the heat transfer surface that bears against an adjacent plate is not used to any appreciable extent for heat transfer between the two media or fluids in the plate heat exchanger. To increase the heat transfer surface while maintaining the load transmitting capacity between adjacent plates, the ridges are made narrower in their central portion, as seen in the main flow direction, than in their end portions. This can be done, for example, by making the pressed ridge narrower, but it can also be done, for example, by giving the pressed ridge a more rounded shape or by reducing the press depth, the loads during operation being allowed to act on the ridge in such manner that the required width will bear against the corresponding ridge of the adjacent plate.

According to a further preferred embodiment, each elongated trough is narrower in a central portion thereof in such manner that the portion of the trough coinciding with the bottom plane has an extension in the transverse direction which is smaller in the central portion of the trough in relation to the extension in the end portions of the trough. As described above in connection with a preferred embodiment of the ridges, this affords a high degree of utilization of the heat transfer surface and provides for a strong plate. Depending on the field of application, both the ridges and the troughs may be designed as described above, but it is also conceivable to design only the ridges or only the troughs in this way. The ridges and the troughs may, for example, be designed differently cases involving two fluids which have clearly differing characteristics in terms of the required pressure or heat transfer capacity.

In a preferred embodiment, the ridges and troughs in one and the same row have the same extension in the main flow direction. A plate which, in this respect, is symmetrical is thereby obtained. This facilitates the manufacture thereof and, in most fields of application, results in symmetrical loads on the surrounding environment.

According to a further preferred embodiment, the ridges and trough in one and the same row have different extensions in the main flow direction. By designing the plate in this way, transverse connections extending between the main flow channels can be obtained, said transverse connections compensating for the fact that the pressure of the fluids drops slightly in the main flow direction and that the fluids have already been distributed to a certain extent at a preceding stage upstream of the main flow direction. Thus, the relation between the main flow channels and the transverse connections may be optimised in terms of pressure drop and fluid distribution along the entire extension of the plate in the main flow direction.

In another preferred embodiment, the ridges and troughs located next to each other in the transverse direction have the same extension in the main flow direction. A plate which, in this respect, is symmetrical is thereby obtained, which facilitates the manufacture thereof and, in most fields of application, results in symmetrical loads on the surrounding environment.

According to yet another preferred embodiment, the ridges and troughs located next to each other in the transverse direction have different extensions in the main flow direction. By designing the plate in this way, transverse connections may be obtained which extend between the main flow channels and compensate for the fact that the flow, in most cases, is slightly lower in the outer portions of the heat transfer surface of the plate. This allows the relation between the main flow channels and the transverse connections to be optimised in terms of, for example, pressure drop and fluid distribution along the entire extension of the plate in the transverse direction.

According to a preferred embodiment, the rows of ridges and troughs are arranged in such manner that they, along a first line in the transverse direction, each present a ridge and, along a second line in the transverse direction, each present a trough. A satisfactory cross distribution of the fluids is thus obtained also in cases of small pressure drops.

According to a further preferred embodiment, the rows of ridges and troughs are arranged in such manner that, along a line in the transverse direction, every second row presents a ridge and every second row presents a trough. The transverse connections between the main flow channels will essentially follow a number of diagonal lines across the heat transfer surface of the plate, which results in a satisfactory distribution of the fluids over the width of the plate, since a flow through a transverse connection can easily pass the next transverse connection (to yet another main flow channel) without its direction of flow being altered to any appreciable extent.

Preferably, each channel portion is stepwise divided into a number of essentially plane step portions which are arranged one after the other in the main flow direction and displaced in relation to each other along a normal to the central plane of the plate. This design makes the plate considerably more rigid and strong than before, on the one hand because the portions interconnecting the step portions will extend at least partially along the normal to the plate and, thus, support some of the load and, on the other hand, because the relatively displaced portions will considerably increase the moment of inertia of the plate in bending and, thus, the section modulus. This means that the deflection caused by a certain load will be drastically reduced since, for most plate designs, the relation between the deflection and the length of the portion subjected to the force is more than linear. By designing the channel portions in this way, an additional advantage is obtained, namely that the steps formed in the main flow channels will effectively prevent the formation of a film of fluid which may otherwise occur across the heat transfer surface of the plate. The formation of a film has a detrimental effect on the heat exchange, i.e. the heat exchange is reduced, and also increases the risk of fouling.

Advantageously, every second step portion is located in a first step plane, which is essentially parallel to the central plane of the plate, and the other step portions are located in a second step plane, which is essentially parallel to the central plane of the plate. From the point of view of manufacture, this is a preferred embodiment, which also affords a symmetric distribution of forces.

Preferably, each step portion has an extension in the main flow direction which is about half of the extension of the ridges and troughs in the main flow direction. This affords a particularly favourable distribution of forces between the juxtaposed rows of ridges and troughs while affording the channel portion surfaces a suitable film-preventing capacity.

According to a preferred embodiment, the position of each step portion along a normal to the central plane of the plate is constant in the main flow direction, the step portions being arranged to form, together with the corresponding step portions of another plate, a channel which has a corrugated extension and a channel width along said normal which is constant in the main flow direction. Every second step portion is tangent to a first plane and the other step portions are tangent to a second plane, the first plane and the second plane being essentially parallel to the central plane of the plate. From the point of view of manufacture, this is a preferred embodiment which, at the same time, affords the channel portion surfaces a suitable film-preventing capacity. Furthermore, the step portions of adjacent plates will interact to further increase the film-preventing capacity.

In a further preferred embodiment, the position of each step portion along a normal to the central plane of the plate varies along the main flow direction, the step portions being arranged to form, together with the corresponding step portions of another plate, a channel which has a channel width along said normal which varies in the main flow direction. According to a variant thereof, every second step portion is tangent to a first plane and the other step portions are tangent to a second plane, the first and second planes being essentially parallel to the central plane of the plate. The variation in the width of the channel in the main flow direction affords an excellent film-preventing capacity. Alternatively, it is possible to have a certain degree of inclination of the planes to which the step portions are tangent in order to obtain a more or less continuous increase or decrease of the width of the channel in the main flow direction. This design allows pressure drops or any changes in phase (and associated changes in volume) of the fluids to be taken into account.

According to a preferred embodiment, the position of each step portion along a normal to the central plane of the plate varies in the transverse direction, the step portions being arranged to form, together with the corresponding step portions of another plate, a number of channels which have channel widths along said normal which vary along the transverse direction. Owing to this design, any unsymmetrical positioning of ports or inlet and outlet portions, which will result in flow paths of varying length across the plate, can be taken into account. By varying the position of the step planes in the transverse direction, the desired pressure drop for different portions of the plate in the transverse direction can be chosen, which allows a uniform heat exchange to be obtained even if the ports are unsymmetrically positioned or if, for other reasons, there is any other dissymmetry.

The plate pack of the invention comprises a plurality of heat transfer plates according to the invention. The problems solved and the solutions obtained by means of the preferred embodiments of the heat transfer plates are, in most cases, associated with the use of the plates in a plate pack and a plate heat exchanger, respectively, and will not be reiterated. However, some of the problems solved and advantages obtained will be described in more detail, since they can be understood more clearly in relation to the use of the plates in a plate pack or a plate heat exchanger.

The plate pack is characterised in that the heat transfer portion has a plurality of juxtaposed rows of said ridges and troughs, said rows extending along the main flow direction, that the rows of ridges and troughs are separated from each other in a transverse direction, which is essentially perpendicular to the main flow direction and extends along the central plane of the plate, by essentially plane channel portions of the heat transfer portion, which extend essentially parallel to the central plane of the plate, that each row presents alternating elongated ridges and elongated troughs which extend in said main flow direction, that the transition between each ridge and an adjacent trough in the same row is formed by a continuous, essentially straight transition portion of the plate, which is inclined relative to said central plane of the plate and of which a first part forms an end wall of said ridge and a second part forms an end wall of the adjacent trough, that a main part of the fluid stream flows in the main flow direction in main flow channels which extend along the main flow direction and which are formed by the essentially plane channel portions of two adjacent heat transfer plates, and that a small part of the fluid stream flows in the transverse direction in the portions where the troughs of two adjacent heat transfer plates form open transverse connections between the main flow channels.

This design is a satisfactory compromise between the seemingly incompatible construction requirements according to which the plate pack is to be strong without causing any appreciable pressure drop. The ridges of the rows bear against each other, and since the material extends directly between the ridges and the troughs (which form an ridge relative to the adjoining plate on the other side) a strong plate is obtained. Owing to the essentially plane channel portions the fluid is conducted through the plate pack without any appreciable pressure drop. Furthermore, the transverse connections allow the fluids to be distributed over the width of the plate without the need for any appreciable pressure to achieve the distribution.

According to a preferred embodiment, the plates constituting the plate pack are identical. Every second plate in the plate pack is usually flipped or rotated about some kind of symmetry line in order for the different interspaces to communicate with different ports of the heat exchanger. Using identical plates in the plate pack, as opposed to using several different plates, allows the number of pressing tools to be reduced.

According to another preferred embodiment, the plates constituting the plate pack are of two different types, so that every second plate is of a first type and every second plate is of a second type. This construction makes it easier to optimise the plate design in terms of fluid flow and transmission of forces between the different plates.

BRIEF DESCRIPTION OF THE DRAWINGS

The invention will be described in more detail below with reference to the accompanying schematic drawings, which by way of example illustrate currently preferred embodiments of the invention.

FIG. 13 is a schematic view of a plate according to a further embodiment.

FIG. 14 is a sectional view of a number of plates of the type shown in FIG. 13.

FIG. 15 is a sectional view of a number of plates of the type shown in FIG. 13.

DETAILED DESCRIPTION OF PREFERRED EMBODIMENTS

Figure 3:
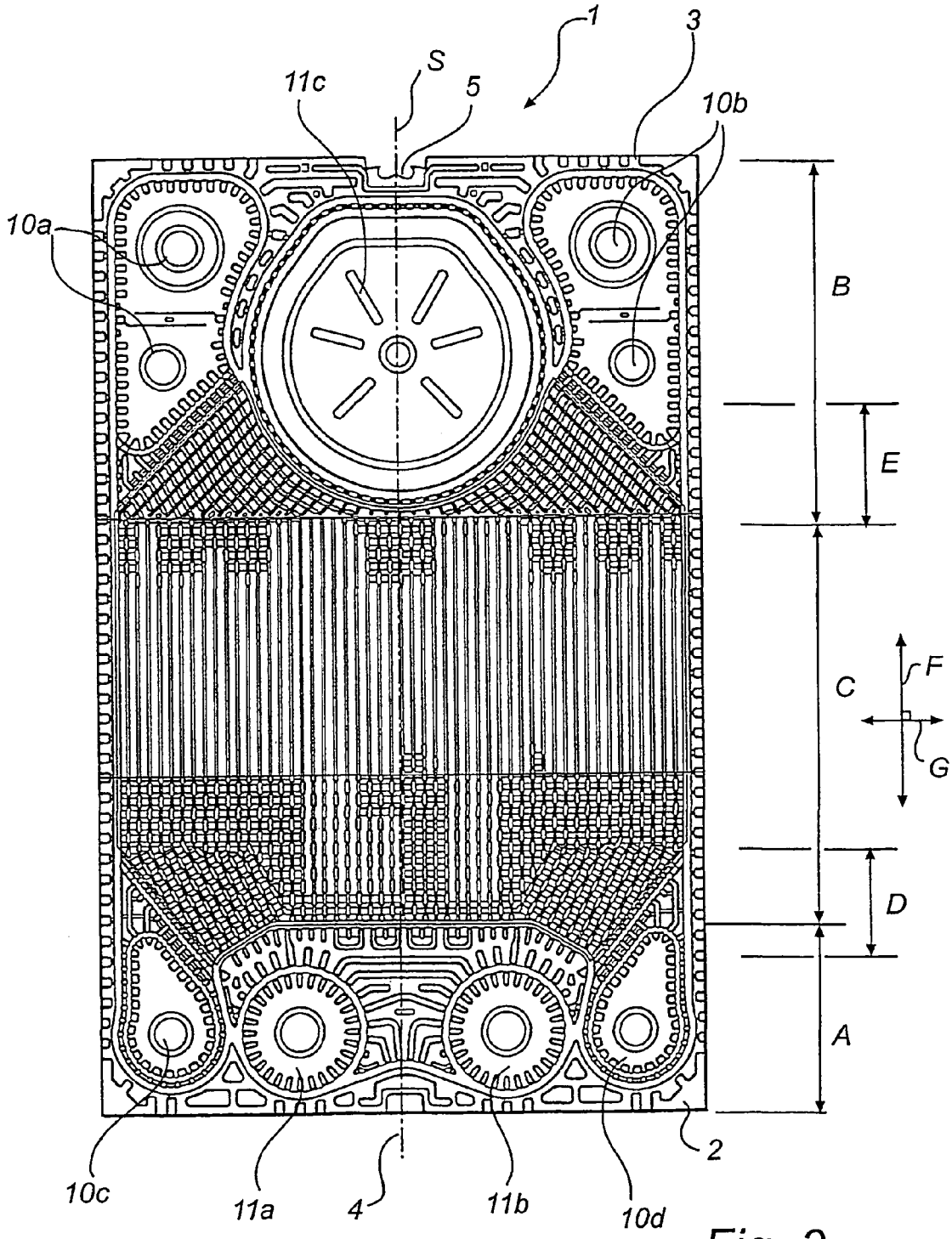
FIG. 3 shows a heat transfer plate according to the invention.

As shown in FIG. 3, the heat transfer plate 1 of the invention has a first port portion A and a second port portion B which are located adjacent to two opposite edge portions 2, 3 of the heat transfer plate 1. The heat transfer plate 1 further comprises a heat transfer surface C which is located between the two port portions A, B. Adjacent to the port portions A, B and, to some extent, coinciding therewith, the plate 1 has portions D, E which are provided with a fluid distribution pattern.

Figure 1:
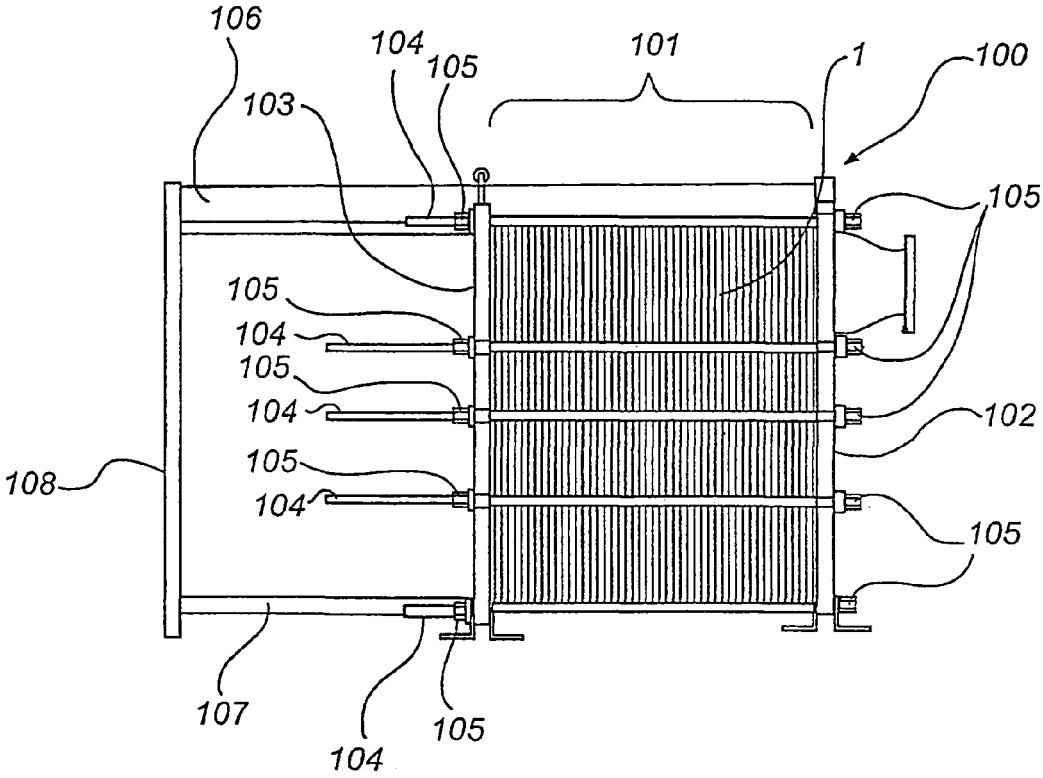
FIG. 1 is a side view of a plate heat exchanger.

The plate 1 is intended to be mounted together with a plurality of similar plates in a plate heat exchanger 100, as shown in FIG. 1. The plates 1 are compressed together to form a plate pack 101 between a frame plate 102 and a pressure plate 103, which are pulled together by means of a number of tie bars 104. The tie bars 104 are threaded, and the frame plate 102 and the pressure plate 103 are pulled together by means of nuts 105 engaging the plates 102, 103 and the tie bars 104. In addition to the frame plate 102 and the pressure plate 103, the frame of the plate heat exchanger 100 also comprises an upper and a lower beam 106 and 107 as well as a pillar arranged adjacent to the end of the beams 106, 107 facing away from the frame plate 102. At the edges 2, 3 of the port portions A, B, the heat transfer plates 1 are provided with recesses 4, 5 (See FIG. 3) which are adapted to engage respectively the lower and the upper beam 107, 106.

Figure 2:
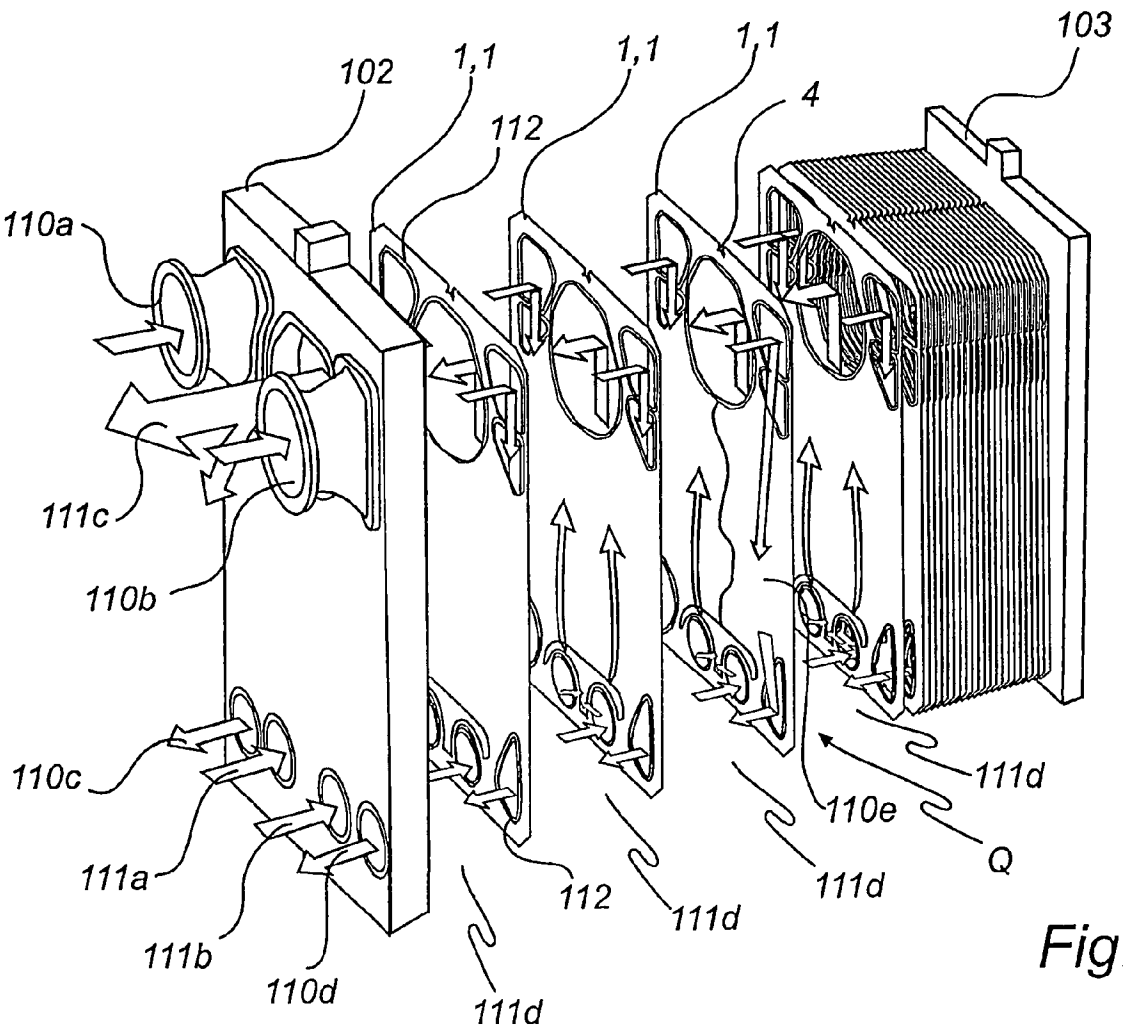
FIG. 2 is an exploded view of the plate heat exchanger of FIG. 1.

As shown in FIG. 2, the frame plate 102 is provided with connecting holes 110*a–d*, 11*a–c* which communicate with the ports 10*a–d*, 11*a–c* in the heat transfer plate 1. These ports 10*a–d*, 11*a–c* include holes extending through the plate 1. Gaskets are provided around the ports 10*a–d*, 11*a–c* of the plate 1, and the heat transfer surface C is enclosed by gaskets 112 arranged in grooves pressed into in the plate 1.

The gaskets 112 are used to respectively seal off and allow a fluid flow by the connections 111*a–c* and the ports 11*a–c* communicating with every second plate interspace 111*d* and the connections 110*a–d* and the ports 10*a–e* communicating with the other plate interspaces 110*e*. Thus, a first fluid will flow in a flow area in every second plate interspace 111*d* and a second fluid will flow in a flow area in the other plate interspaces 110*e*. There is no direct contact between the two fluids. Instead, heat is exchanged by the intermediary of the heat transfer surfaces C of the plates 1. FIG. 2 shows three separate plate pairs 1,1, each being composed of two heat transfer plates 1 that have been joined together. The rest of the plates 1 have been assembled to form a plate pack. The arrow Q indicates a plate pair 1,1 in which one of the plates 1 (the front plate in the figure) is shown in partial section to illustrate the flow in the plate interspace 110*e* between the plates 1 constituting the plate pair 1,1.

Figure 12:
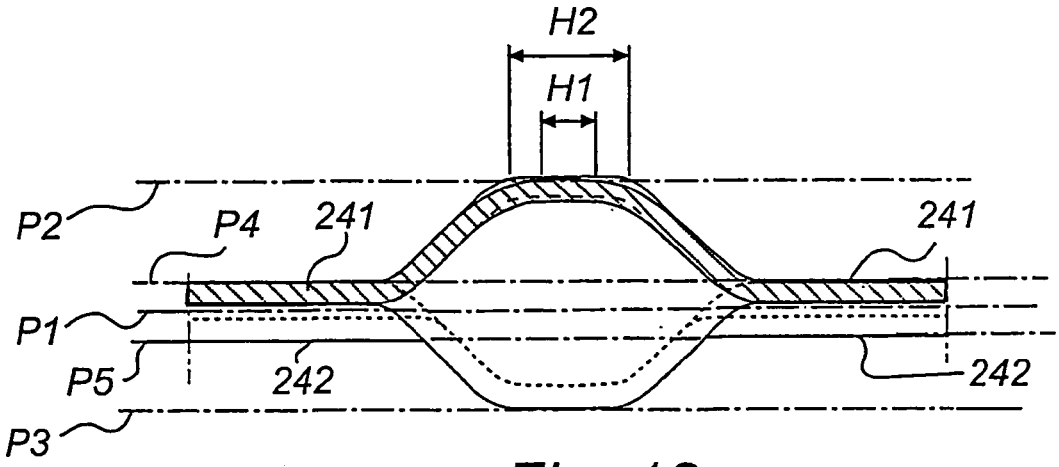
FIG. 12 is a sectional view along the line XII—XII in FIG. 11.
Figure 11:
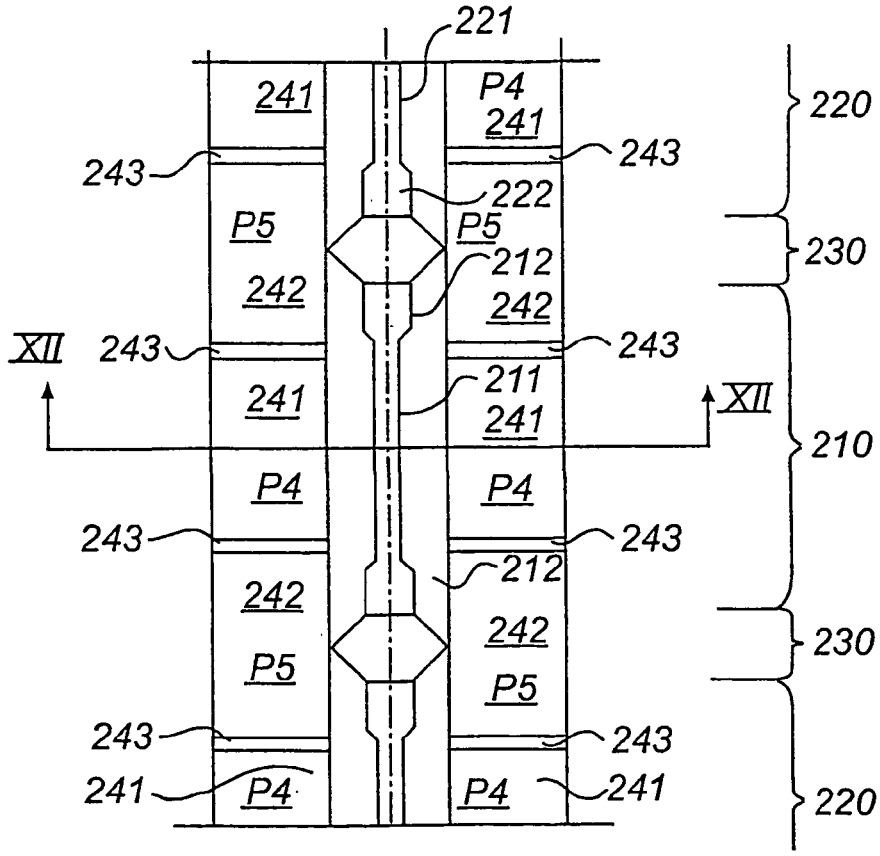
FIG. 11 is detailed segment drawing corresponding to that of FIG. 6.

As shown in FIG. 3, the heat transfer surface C of the heat transfer plate 1 is provided with some kind of pattern. The purpose of this pattern is both to provide points of support, in which adjacent plates bear against each other, and to achieve an appropriate fluid flow over the heat transfer surface C. The pattern is shown in more detail in FIG. 4 and consists of a number of rows 200 of ridges 210 and troughs 220, said rows extending along a main flow direction between the port portions A, B. The main flow direction F thus runs from one port portion to the other. The rows 200 have an essentially corrugated extension in the main flow direction F and form elongated ridges 210, which are tangent to a geometric top plane P2, and elongated troughs 220, which are tangent to a geometric bottom plane P3 (See FIG. 12). The ridges 210 and troughs 220 have the same extension along the main flow direction F. The top plane P2 and the bottom plane P3 are parallel to the geometric central plane P1 of the plate 1. In the figures, the troughs 220 are indicated by contour lines that are slightly thicker than those indicating the ridges 210 (see, for example, FIG. 11).

In a transverse direction G, which is perpendicular to the main flow direction F, the rows 200 of ridges (210) and troughs (220) are separated or delimited by channel portions 240 extending in the main flow direction F.

A straight or plane transition or connecting portion 230 extends between each of the elongated ridges 210 and troughs 220 of the rows 200, said portion 230 being inclined relative to the central plane P1 of the plate 1. The connecting portions 230 are continuous and present a straight unbroken flank, which means that they transmit the compressing forces between the ridges 210 and troughs 220 in a very advantageous manner.

The ridges 210 are narrower in their central portion 211 than in the end portions 212. Thus, the central portion 211 is tangent to the top plane P2 along a width H1 which is smaller than the width H2 along which the end portions 212 are tangent to the top plane P2 (see FIG. 11 and FIG. 12). Correspondingly, the central portion 221 of the troughs 220 is also narrower than the end portions 222 and, thus, each trough 220 is tangent to the bottom plane P3 along a width which is smaller in the central portion 221 than in the end portions 222.

The channel portions 240 are divided into a number of step portions 241, 242 which are arranged one after the other in the main flow direction F. Each step portion 241, 242 extends over the width of the entire channel portion 240 between two rows 200. Every second step portion 241 is arranged in a first step plane P4 and every second step portion 242 is displaced along the normal N in the direction of the central plane PI of the plate 1 and lies in a second step plane P5 (see FIGS. 9–12). The step planes P4 and P5 are parallel to the central plane P1 of the plate 1. The step portions 241, 242 have the same extension in the main flow direction F. The extension of the step portions 241, 242 is about half of the extension of the ridges 210 and the troughs 220, respectively, in the main flow direction F. An unbroken flank 243 extends between the different step portions 241, 242, said flank 243 being inclined relative to the central plane P1 of the plate 1. The flanks 243 of one and the same step portion 242 are symmetrically arranged on both sides of the flank 230 between a ridge 310 and a trough 220. Thus, in every intersection between a ridge 210 and a trough 220 each channel portion 240 presents the step portion 242 in the second step plane P5, whereas opposite the ridges 210 and the troughs 220, respectively, the each channel portion 240 presents the step portion 241 in the first step plane P4.

In the Figures, the same reference numerals are used to designate the ridges 210, the troughs 220, the channel portions 240 etc. for the different embodiments in FIG. 4, FIGS. 5–10 and FIGS. 13–15, since the different portions, in terms of shape, are equivalents to each other. The main difference between the various embodiments is that the ridges 210 and troughs 220 have been configured in different ways, which does not affect the design of each individual ridge 210 or trough 220 to any appreciable extent, and the ridges and troughs have therefore been described without directly associating them with a particular configuration for which they would be intended. A comparison between FIG. 4 and FIG. 5, and FIGS. 14–15, will reveal the difference in configuration.

Figure 4:
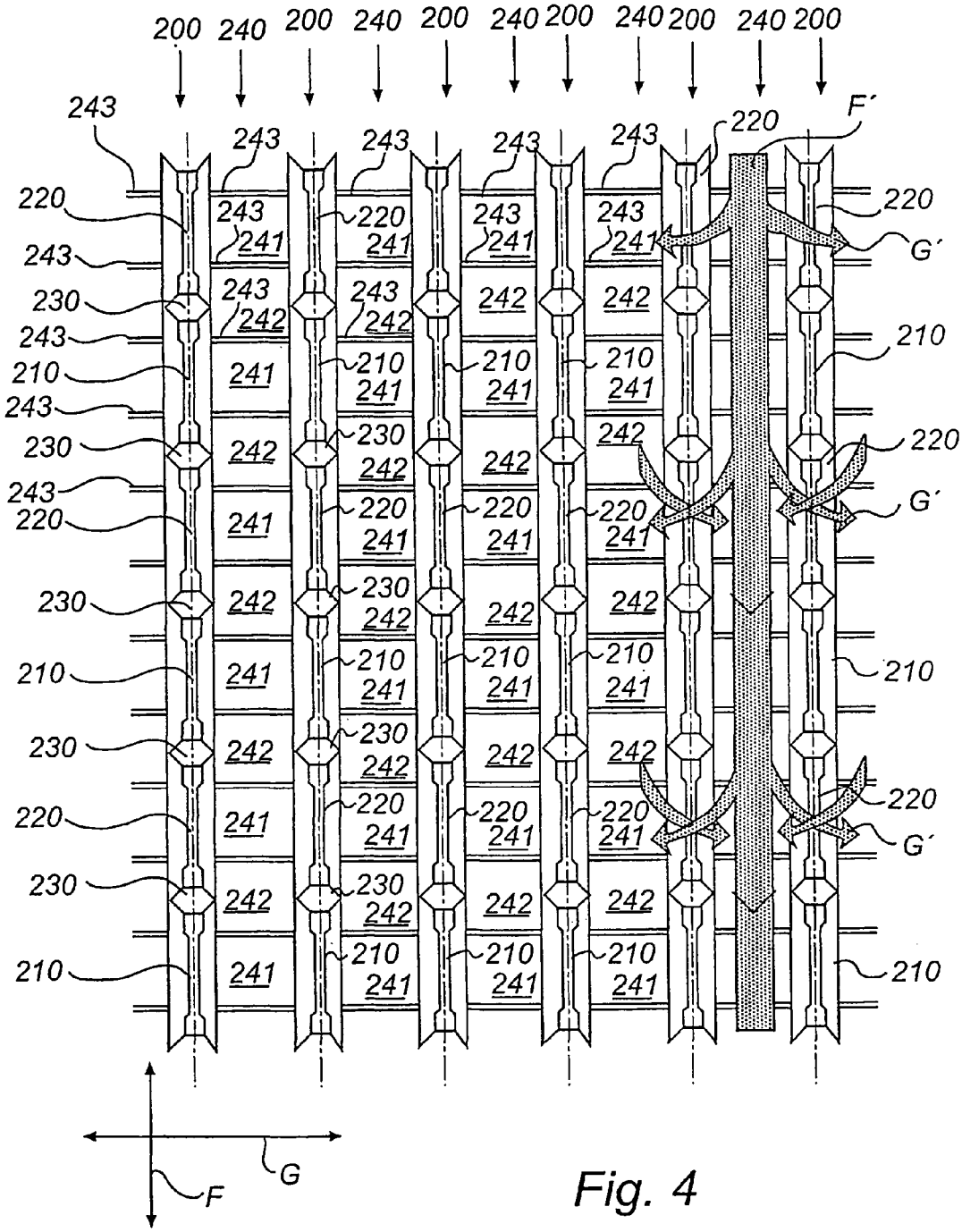
FIG. 4 is a detailed segment drawing of an embodiment of the pattern pressed into the heat transfer surface of the heat transfer plate shown in FIG. 3.

In the embodiment shown in FIG. 4, the ridges 210 and troughs 220 are configured so that, along a line which is parallel to the transverse direction G, all rows 200 present troughs 220 and, along another line which is parallel to the transverse direction G, all rows 200 present ridges 210. In the main flow direction F, every second, transverse line is a line of ridges 210 and every second line is a line of troughs 220.

In the embodiment shown in FIGS. 5–10, the ridges 210 and troughs 220 are configured so that, along a line which is parallel to the transverse direction G, every second row 200 presents a trough 220 and every second row a ridge 210. In this case, a line that is drawn so as to be tangent to only ridges 210 or only troughs 220 (corresponding to the lines in the embodiment shown in FIG. 4) will be a diagonal line forming an angle with both the transverse direction G and the main flow direction F.

The step portions 241, 242 are configured so that, along a line which is parallel to the transverse direction G, all channel portions 240 present step portions which are tangent to the same step plane. Along a line which is parallel to the transverse direction G, all channel portions 240 present the step portion designated 241 and, along another line which is parallel to the transverse direction G, all channel portions 240 present the step portion designated 242.

The purpose of the step portions 241, 242 being relatively displaced is to provide a plate 1 which is significantly stronger than what was previously possible. Furthermore, owing to the flank 243, which interconnects the step portions 241, 242, film formation in the channels can be prevented, which is an advantage.

Figure 7:
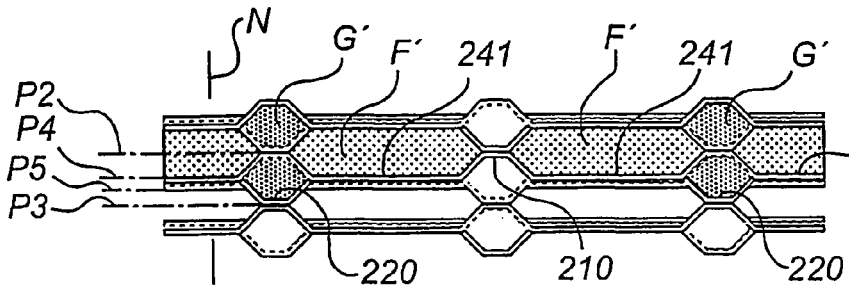
FIG. 7 is a sectional view along the line VII—VII in FIG. 6.
Figure 8:
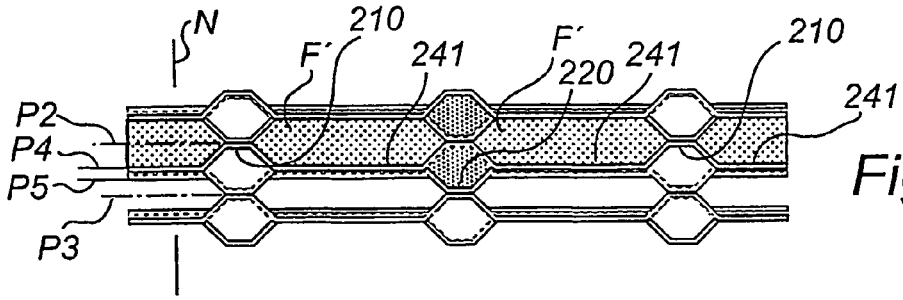
FIG. 8 is a sectional view along the line VIII—VIII in FIG. 6.
Figure 6:
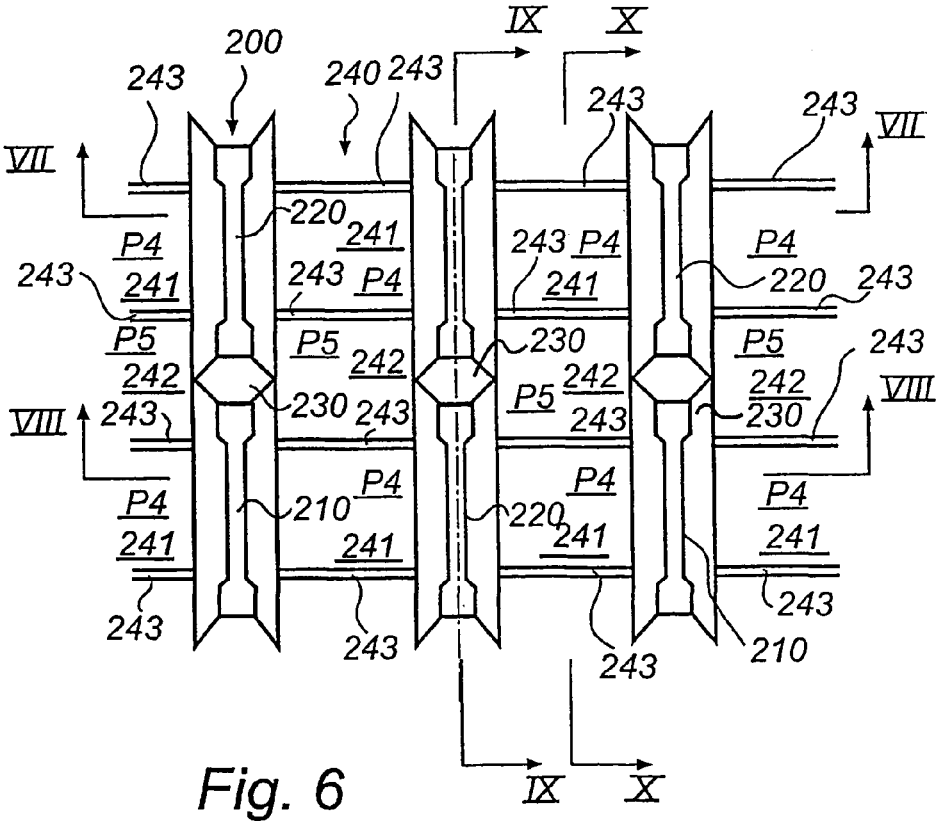
FIG. 6 is a detailed segment drawing corresponding to an enlarged version of the detailed segment drawing of FIG. 5.
Figure 9:
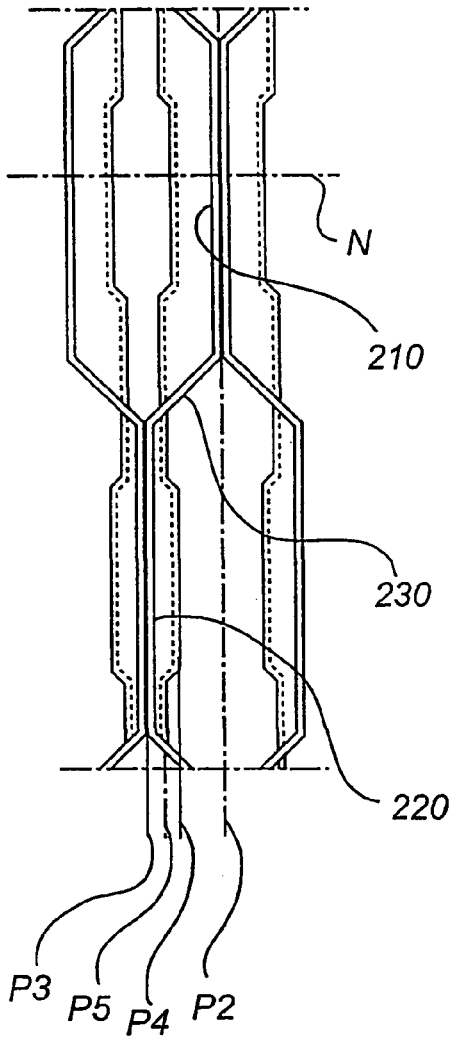
FIG. 9 is a sectional view along the line IX—IX in FIG. 6.
Figure 10:
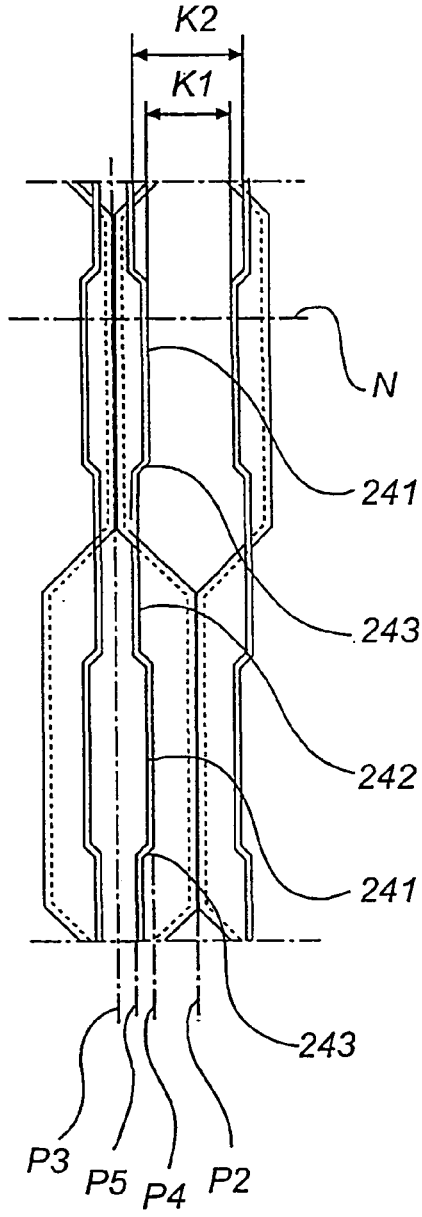
FIG. 10 is a sectional view along the line X—X in FIG. 6.

As described above, the plates 1 are adapted for use in a plate pack 101 in a plate heat exchanger 100. For this purpose, every second plate is flipped about a symmetry axis S which is parallel to the main flow direction F. The ridges 210 of one plate 1 will bear against the corresponding ridges 210 of an adjacent plate 1. In the same way, the troughs 220 of said plate 1 will form ridges 210 on the other side, which will bear against the ridges 210 of another adjacent plate. This is clearly illustrated in FIGS. 7–10. The channel portions 240 will thus form main flow channels F' which extend in the main flow direction F. In addition, transverse connections G' will be formed between the main flow channels F' in the places where the adjacent plates 1 do not bear against each other. FIG. 7 shows the transverse connections G' between the main flow channels F'. FIG. 8 is a sectional view in which the ridges 210 bear against each other and define and separate the main flow channels F'. The main flow channels F' and the transverse connections G' are also suggested schematically by the flow lines in the right-hand part of FIG. 4 and FIG. 5.

The embodiment described above leads to a construction in which the main part of the fluid stream over the heat transfer surfaces C between the port portions A, B will flow in the main flow channels F' without any appreciable pressure drop. Furthermore, the embodiment described allows the fluid flow to be distributed between the different main flow channels F' so that a uniform flow is obtained over the entire heat transfer surface C. Owing to this design, the required transverse flows will occur without the need for any appreciable pressure. Thus, the major part of the fluid stream will flow in the main flow channels F' and only a minor part of the stream will flow between the main flow channels F' via each individual transverse connection G'.

Figure 5:
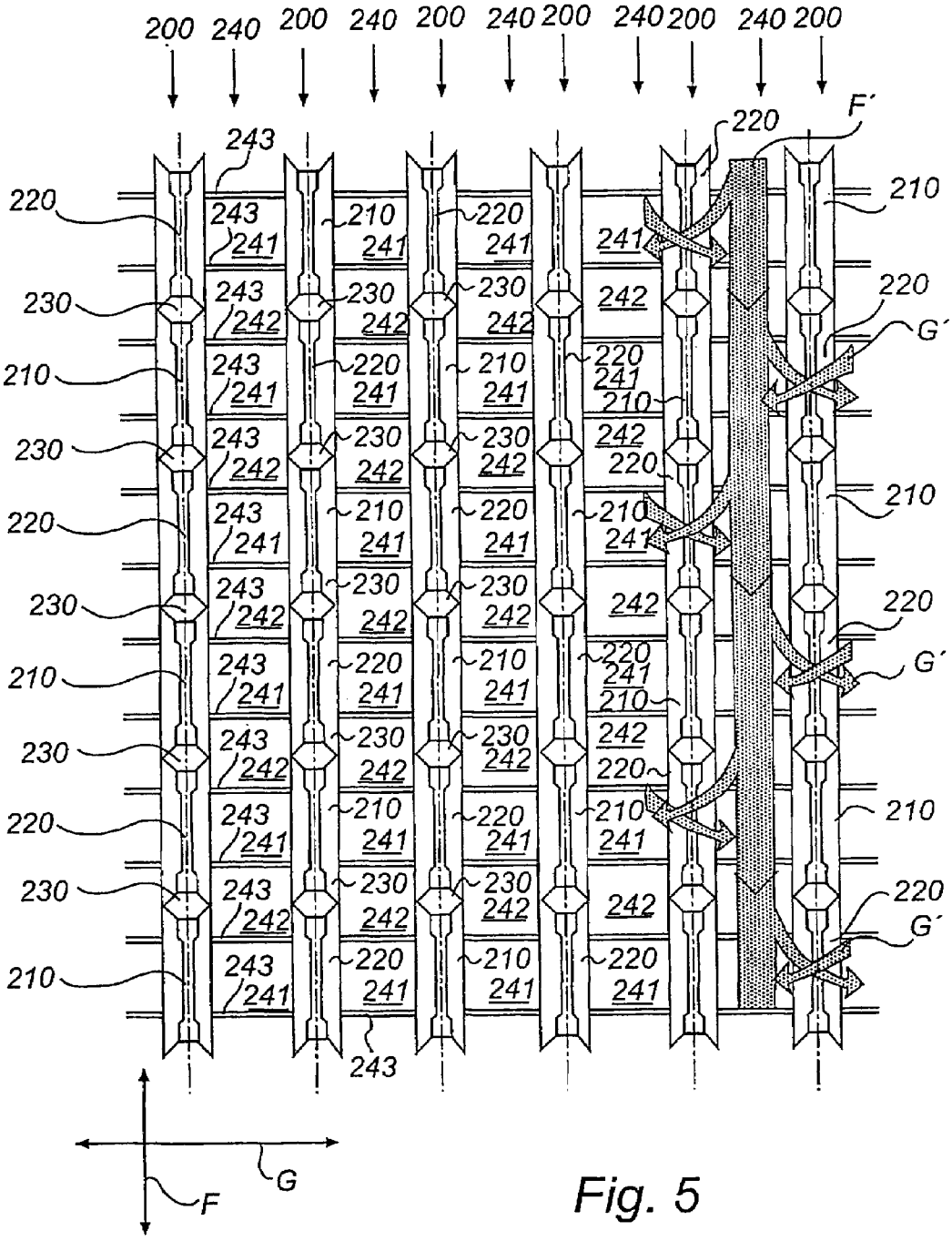
FIG. 5 is a detailed segment drawing of a second embodiment of the pattern pressed into the heat transfer surface of the heat transfer plate shown in FIG. 3.

In FIGS. 4 and 5, the paths of the main flow F' and the transverse flows G' are illustrated very schematically. As shown, all channel portions in FIG. 4 communicate with each other in the same places in the main flow direction F, whereas the channel portions 240 in FIG. 5 communicate in different places in the main flow direction F.

As shown, particularly in FIGS. 4 and 5, the channel portions 240 have an extension which in the transverse direction is about twice as great as the extension of each row 200 in the transverse direction G. The positioning of the step planes P4 and P5 means that the step portions 241 and 242 of two adjacent plates 1 will form main flow channels F' whose channel width K (or height) along the plate normal N varies between two constant channel widths K1, K2 (see FIG. 10) in the main flow direction F.

As shown in FIGS. 14 and 15, the position of the step planes P4 and PS may be varied along the transverse direction G. For the sake of clarity, only the step plane P4 is shown in FIGS. 14 and 15. In the same way as in the other embodiments, PS has been displaced a short distance along the normal N. Moreover, the illustration of the ridges 210 and troughs 220 is highly simplified. Since the step planes P4, P5 can be arranged in any optional position relative to the points 210, 220 of support, a channel 240 whose press depth (the width K along the normal) varies in the transverse direction G or in the main flow direction F can be created. The channel 240 on the other side of the plate 1 (the adjacent plate interspace) will have a channel width K which in a corresponding manner will decrease or increase. By choosing different channel widths K, the pressure drop along different flow paths can be controlled in order to obtain the same pressure drop regardless of the varying geometric length of said flow paths. In the port configuration shown in FIG. 13, the flow path L, for example, is significantly longer than the flow path M. This implies that the fluid flow along the flow path L will transfer more heat. To obtain the same outlet temperature or vapour quality, the flow along the flow path L has to be greater than the flow along the flow path M. Thus, the flow needs to be greater in the longer path, which in turn means that the pressure drop per meter along the flow path L has to be even smaller than along the flow path M.

It will be appreciated that a number of modifications of the embodiments of the invention described herein are possible within the scope of the invention, which is defined by the appended claims.

For example, the ridges and troughs of one and the same row may have different extensions in the main flow direction. The extension of the ridges may be greater or smaller than that of the troughs. According to another alternative, the extension of the ridges and/or troughs may vary in the main flow direction. In a further alternative, the extension of the ridges and troughs relative to each other may change in the main flow direction, whereby a solution compensating for pressure drops and/or any changes in state of one or both fluids. The relative extension of the ridges and troughs may be varied in a large number of ways depending on the field of application. Furthermore, the extension of the ridges and troughs and the relation between them may, for example, be varied along the transverse direction, to compensate, for example, for the fact that, in most cases, the fluid flow will initially be slightly unevenly distributed.

According to an alternative embodiment, the step portions may be arranged in such manner that the channel width of the main flow channels along the plate normal is constant and the sidewalls of the channel (i.e. the step planes) are moved in the same direction in the same position in the main flow direction. This may be achieved, for example, by alternating the different step portion planes along a line in the transverse direction.

According to a further alternative embodiment, the step planes are inclined so that the channel width will change continuously in the main flow direction. The channel width may also be changed by arranging the step portions in a number of different planes whose relative distance varies in the main flow direction, and not only in two planes. The relative position and height of the step portions, both in the main flow direction and in the transverse direction, can be varied in a large number of ways.

It is also conceivable to have various embodiments, in which two or more different types of plates are used to form the plate pack in the plate heat exchanger. A common solution is to use two different plates which are alternatingly arranged in the plate pack in the plate heat exchanger. Another common variant is to use identical plates (the pressed sheet-metal plate) and two different types of gaskets, so that two different heat transfer plates can be obtained by means of only one pressing tool. However, the advantage of the plate pattern described above is that is allows one type of plate to be designed, which can be flipped and used to form all the plates of the plate pack.

The gaskets 112 may be replaced by other types of gaskets, such as ridges bearing against the adjacent plates and being welded onto these plates.

The above description refers to a plate heat exchanger with only one plate pack. However, it is conceivable to use several plate packs in one and the same plate heat exchanger. In that case, the different plate packs may be completely separated from each other or they may communicate in terms of flow.

The invention claimed is:

1. A heat transfer plate for a plate heat exchanger, comprising an inlet portion, an outlet portion and a heat transfer portion which is located between the inlet portion and the outlet portion and which presents a number of ridges and troughs pressed into the plate and extending between a geometric top plane and a geometric bottom plane of the plate, said planes being essentially parallel to a geometric central plane of the plate, wherein the heat transfer portion has a plurality of juxtaposed rows of said ridges and troughs, said rows extending along a main flow direction which extends between the inlet portion and the outlet portion, the rows of ridges and troughs are separated from each other in a transverse direction, which is essentially perpendicular to the main flow direction and extends along the central plane of the plate, by essentially plane channel portions of the heat transfer portion, which extend essentially parallel to the central plane of the plate, each row has alternating elongated ridges and elongated troughs which extend along said main flow direction, the transition between each ridge and an adjacent trough in the same row is formed by a continuous, essentially straight transition portion of the plate, which is inclined relative to said central plane of the plate and of which a first part forms an end wall of said ridge and a second part forms an end wall of the adjacent trough, and each channel portion is stepwise divided into a number of essentially plane step portions which are arranged one after the other in the main flow direction and displaced in relation to each other along a normal to the central plane of the plate.

2. A heat transfer plate according to claim 1, wherein the channel portions have an extension which in the transverse direction is greater than an extension, in the transverse direction, of the respective rows of ridges and troughs.

3. A heat transfer plate according to claim 1, wherein the channel portions have an extension which in the transverse direction is about twice as great as an extension, in the transverse direction, of the respective rows of ridges and troughs.

4. A heat transfer plate according to claim 1, wherein each elongated ridge is narrower in a central portion thereof in such manner that the portion of the ridge coinciding with the top plane has an extension in the transverse direction which is smaller in the central portion of the length of the ridge in relation to an extension in the end portions of the ridge.

5. A heat transfer plate according to claim 1, wherein each elongated trough is narrower in a central portion thereof in such manner that the portion of the trough coinciding with the bottom plane has an extension in the transverse direction which is smaller in the central portion of the length of the trough in relation to an extension in end portions of the trough.

6. A heat transfer plate according to claim 1, wherein the ridges and troughs in one and the same row have the same extension in the main flow direction.

7. A heat transfer plate according to claim 1, wherein the ridges and troughs in one and the same row have different extensions in the main flow direction.

8. A heat transfer plate according to claim 1, wherein the ridges and troughs located next to each other in the transverse direction have the same extension in the main flow direction.

9. A heat transfer plate according to claim 1, wherein the ridges and troughs located next to each other in the transverse direction have different extensions in the main flow direction.

10. A heat transfer plate according to claim 1, wherein the rows are arranged in such manner that they, along a first line in the transverse direction, each present a ridge and, along a second line in the transverse direction, each present a trough.

11. A heat transfer plate according to claim 1, wherein the rows are arranged in such manner that, along a line in the transverse direction, every second row presents a ridge and every other row presents a trough.

12. A plate heat exchanger, comprising a plurality of heat transfer plates according to claim 1.

13. A heat transfer plate according to claim 1, wherein every second step portion is located in a first step plane, which is essentially parallel to the central plane of the plate, and the other step portions are located in a second step plane, which is essentially parallel to the central plane of the plate.

14. A heat transfer plate according to claim 1, wherein each step portion has an extension in the main flow direction which is about half of the extensions of the ridges and troughs in the main flow direction.

15. A heat transfer plate according to claim 1, wherein the position of each step portion along the normal to the central plane of the plate is constant in the main flow direction, the step portions being arranged to form, together with the corresponding portions of another plate, a channel which has a corrugated extension and a channel width along said normal which is constant in the main flow direction.

16. A heat transfer plate according to claim 1, wherein the position of each step portion along the normal to the central plane of the plate varies in the main flow direction, the step portions being arranged to form, together with the corresponding step portions of another plate, a channel which has a channel width along said normal which varies in the main flow direction.

17. A heat transfer plate according to claim 1, wherein the position of each step portion along the normal to the central plane of the plate varies in the transverse direction, the step portions being arranged to form, together with the corresponding step portions of another plate, a number of channels having channel widths along said normal which vary in the transverse direction.

18. A plate pack comprising a plurality of heat transfer plates which each comprise an inlet portion, an outlet portion and a heat transfer portion which is located between the inlet portion and the outlet portion and which presents a number of ridges and troughs pressed into the plate and extending between a geometric top plane and a geometric bottom plane of the plate, said planes being essentially parallel to a geometric central plane of the plate, a fluid being intended to flow in a number of flow areas that are formed by the interspaces between the heat transfer plates constituting the plate pack along a main flow direction which extends between the inlet portion and the outlet portion, wherein the heat transfer portion has a plurality of juxtaposed rows of said ridges and troughs, said rows extending in the main flow direction, the rows of ridges and troughs are separated from each other in a transverse direction, which is essentially perpendicular to the main flow direction and extends along the central plane of the plate, by essentially plane channel portions of the heat transfer portion, which extend essentially parallel to the central plane of the plate, each row presents alternating elongated ridges and elongated troughs which extend in said main flow direction, the ridges of two juxtaposed heat transfer plates bear against each other, the transition between each ridge and an adjacent trough in the same row is formed by a continuous, essentially straight transition portion of the plate, which is inclined relative to said central plane of the plate and of which a first part forms an end wall of said ridge and a second part forms an end wall of the adjacent trough, each channel portion is stepwise divided into a number of essentially plane step portions which are arranged one after the other in the main flow direction and displaced in relation to each other along a normal to the central plane of the plate, a main part of the fluid stream flows in the main flow direction in main flow channels which extend along the main flow direction and which are formed by the essentially plane channel portions of two juxtaposed heat transfer plates, and a small part of the fluid stream flows in the transverse direction in portions where the troughs of two juxtaposed heat transfer plates form open transverse connections between the main flow channels.

19. A plate pack according to claim 18, wherein the position of the channel portions along the normal to the central plane of the respective plates is essentially constant in the main flow direction, the channel portions of a plate forming, together with the corresponding channel portions of an adjacent plate, a channel which has a corrugated extension in the main flow direction and a channel width along said normal which is constant in the main flow direction.

20. A plate pack according to claim 18, wherein the position of the channel portions along the normal to the central plane of the respective plates varies in the main flow direction, the channel portions of a plate forming, together with the corresponding channel portions of an adjacent plate, a channel which has a channel width along said normal which varies in the main flow direction.

21. A plate pack according to claim 18, wherein the plates constituting the plate pack are identical.

22. A plate pack according to claim 18, wherein the plates constituting the plate pack are of two different types, so that every second plate is of a first type and every second plate is of a second type.

23. A plate heat exchanger, comprising a plurality of heat transfer plates which are arranged in a number of plate packs according to claim 18.

* * * * *